United States Patent [19]

Watada

[11] 4,137,726

[45] Feb. 6, 1979

[54] CAPACITY CONTROL SYSTEM OF COMPRESSOR FOR HEAT-PUMP REFRIGERATION UNIT

[75] Inventor: Masahiro Watada, Kusatsu, Japan

[73] Assignee: Daikin Kogyo Co., Ltd., Osaka, Japan

[21] Appl. No.: 852,733

[22] Filed: Nov. 18, 1977

[30] Foreign Application Priority Data

Nov. 22, 1976 [JP] Japan ..... 51-156934[U]

[51] Int. Cl.[2] ..... F25B 13/00; F25B 41/00

[52] U.S. Cl. ..... 62/196 C; 62/324

[58] Field of Search ..... 62/196 R, 196 C, 160, 62/324

[56] References Cited

U.S. PATENT DOCUMENTS

| | | | |
|---|---|---|---|
| 2,394,166 | 2/1946 | Gibson | 62/196 C X |
| 2,904,971 | 9/1959 | Kosfeld | 62/196 C |
| 3,063,251 | 11/1962 | Boehmer et al. | 62/196 C |
| 4,017,286 | 4/1977 | English et al. | 62/160 |

FOREIGN PATENT DOCUMENTS

| | | | |
|---|---|---|---|
| 167352 | 4/1956 | Australia | 62/160 |
| 469751 | 11/1950 | Canada | 62/160 |
| 118858 | 10/1974 | Japan. | |

*Primary Examiner*—J. Karl Bell

*Attorney, Agent, or Firm*—Cushman, Darby & Cushman

[57] ABSTRACT

A capacity control system of compressor for heat-pump refrigeration unit including a bypass adapted to communicate the suction side of the compressor with a bypass port opened to a cylinder chamber of the compressor, and a valve mounted adjacent the bypass port for opening and closing the bypass. The valve is subject at the back thereof to the pressure of a refrigerant in a refrigerant passage which becomes a low pressure area in a cooling mode operation of the refrigeration unit and becomes a high pressure area in a heating mode operation of the unit, and the valve is caused to be automatically opened or closed by the change in the pressure, so that the performance of the compressor can be automatically controlled in such a manner that its capability is reduced in the cooling mode operation and increased in the heating mode operation.

4 Claims, 7 Drawing Figures

CAPACITY CONTROL SYSTEM OF COMPRESSOR FOR HEAT-PUMP REFRIGERATION UNIT

LIST OF PRIOR ART REFERENCE (37 CFR 1.56 (a))

Japanese Utility Model Laid-Open Publication No. 118858/1974

This invention relates to a heat-pump refrigeration unit which is capable of automatically effecting control of the effective suction gas flow in its compressor in a refrigerating circuit so as to change its level when the unit operates in a heating mode and in a cooling mode.

Generally, there is a greater difference between indoor temperature and outdoor temperature when space heating is carried out by means of a refrigeration unit than when space cooling is carried out thereby. Thus the heating load is higher than the cooling load, and consequently a heat-pump refrigeration unit is unable to perform space cooling and space heating satisfactorily unless the compression capability of its compressor becomes higher in a heating mode operation of the refrigeration unit than in a cooling mode operation of the refrigeration unit. In order to provide a solution to this problem, a proposal has hitherto been made to communicate the suction side of the compressor with the interior of a cylinder chamber of the compressor through a bypass mounting an on-off valve therein. The on-off valve is opened in a cooling mode operation of the refrigeration unit to reduce the effective cylinder volume of the compressor so as to thereby reduce the effective suction gas flow in the compressor, and is closed in a heating mode operation of the refrigeration unit to increase the effective cylinder volume of the compressor so as to thereby increase the effective suction gas flow in the compressor. By this arrangement, the effective suction gas flow in the compressor can be raised to a higher level in a heating mode operation of the refrigeration unit than in a cooling mode operation of the unit. However, there has been made no proposal to provide means for automatically actuating such on-off valve.

The object of the present invention is to provide a capacity control system of a compressor for a heat-pump refrigeration unit which performs the function of automatically and positively controlling the effective suction gas flow in the compressor by actuating an on-off valve for opening and closing a bypass communicating the suction side of the compressor with a cylinder chamber of the compressor by utilizing a change in pressure in a refrigerant passage which occurs when the refrigeration unit is switched from a heating mode to a cooling mode or vice versa.

Additional and other objects, features and advantages of the invention will become apparent from the description set forth hereinafter when considered in conjunction with the accompanying drawings, in which.

Figure 1:
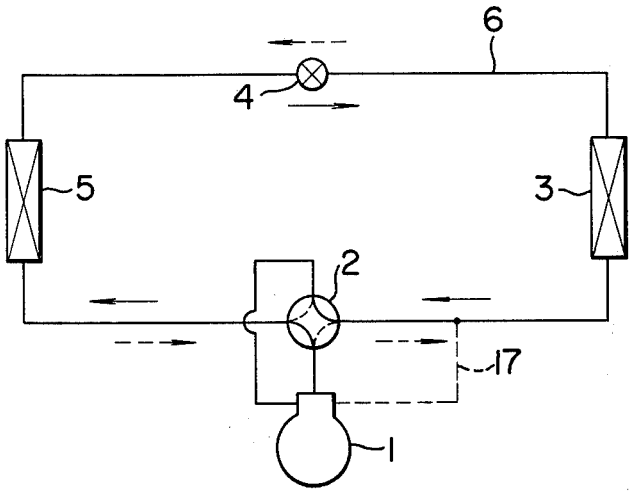
FIG. 1 is a refrigerating circuit diagram according to one embodiment of the present invention.

Referring to FIG. 1, there is shown a heat-pump type refrigeration unit comprising a compressor 1, a four way valve 2, an inboard heat exchanger 3, an expansion valve 4 and an outboard heat exchanger 5, all of which are operatively interconnected by means of a refrigerating circuit 6. The refrigeration unit operates in a cooling mode when a refrigerant discharged from the compressor 1 is circulated in the direction indicated by the solid line arrow by means of the four way valve 2, and operates in a heating mode when the refrigerant is circulated in the direction indicated by the broken line arrow by means of the four way valve 2. The reference numeral 17 designates a connecting passage which communicates a portion of refrigerant circuit 6, between the four way valve 2 and inboard heat exchanger 3, with a bypass port 18 opened to a cylinder chamber 10 of the compressor 1, said portion becoming a low pressure area in a cooling mode operation of the refrigeration unit and becoming a high pressure area in a heating mode operation of the refrigeration unit.

Figure 2:
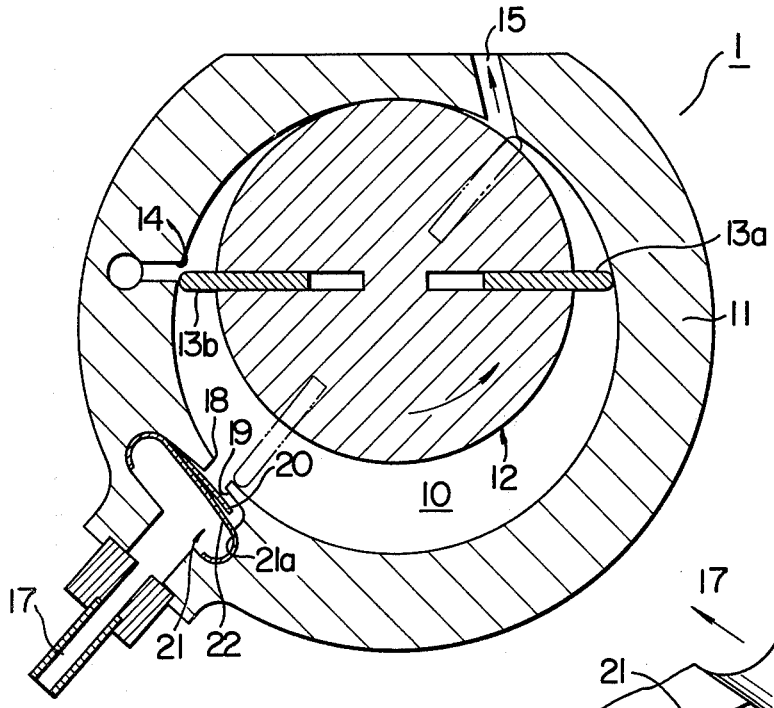
FIG. 2 is a sectional view showing the essential part of a compressor shown in FIG. 1.
Figure 3:
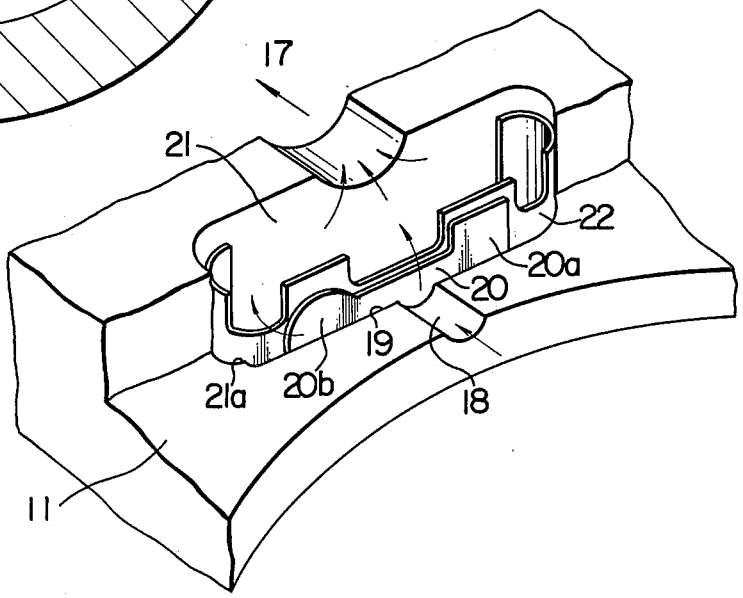
FIG. 3 is an enlarged, perspective view of a check valve portion shown in FIG. 2.

FIG. 2 shows in a sectional view of the essential part of the compressor 1. As shown, a pair of vanes **13*a* and 13*b* are mounted on a rotor 12 and extend in opposite directions, which rotor is eccentrically arranged in the cylinder chamber 10 of a cylinder 11. The cylinder 11 is formed with a suction port 1 and an outlet port 15. The bypass port 18 is formed in an inner wall of the cylinder chamber 10 and is disposed ahead of the inlet port 14 with respect to the direction of movement of the vanes 13*a* and 13*b*. A valve chamber 21 communicating with the bypass port 18 at one end is formed in the wall of the cylinder chamber 10 and communicates with the connecting passage 17 at the other end. Mounted in the valve chamber 21 in a position against a valve seat 19 is a check valve 20 which is in the form of plate spring. More specifically, as shown in FIG. 3, the check valve 20 is formed of an elongated strip and has one end portion 20*a* joined by spot welding to a valve stopper 22 in the form of plate spring of a C-shaped cross section. Thus the check valve 20 and the valve stopper 22 are integral with each other with the former supported by the latter. The valve stopper 22 is force fitted in the valve chamber 21 from an upper or lower surface of the cylinder 11. By arranging the valve stopper 22 in the valve chamber 21, one end portion 20*a* of the check valve 20 is interposed between the valve stopper 22 and a wall surface of the cylinder 11 adjacent to the bypass port 18. The valve stopper 22 abuts against a stepped portion 21*a* of the valve chamber 21 to form a space between the valve stopper 22 and a wall surface portion adjacent to the bypass port 18, in which space the other end portion 20*b* of the check valve 20 is capable of pivotably moving about the fulcrum of the one end portion 20*a* to open and close the valve 20. Accordingly, when the pressure in a portion of the cylinder chamber 10 near the bypass port 18 is higher than the pressure in the connecting passage 17, the other end portion 20*b* of the check valve is brought into close contact with the valve stopper 22 to move the valve to an open position. Conversely, when the pressure in the cylinder chamber 10 is lower than the pressure in the connecting passage 17, the other end portion 20*b*** of the valve 20 is brought into close contact with the valve seat 19 to move the valve 20 to a closed position.

In this vane-type compressor, the rotor 12 is eccentrically mounted in the cylinder chamber 10, so that a crescent-shaped space is defined between the rotor 12 and the cylinder 11. The outlet port 15 is disposed at the end portion of the cylinder chamber 10 as viewed in the direction of rotation of the rotor 12, that is, the direction indicated by a solid line arrow in FIG. 2. As described above, the suction port 14 is disposed at the predetermined position in the inner wall surface of the cylinder 11. That is, the suction port 14 is disposed such that the vane 13*b* on the suction side gets out of communication with the suction port 14 when the volume of the cylinder chamber enclosed by the two vanes 13*a* and 13*b* and the cylinder 11 is nearly maximized (that is, when the amounts of lift of the two vanes 13*a* and 13*b* shown in solid lines in FIG. 2 are equal to each other). The bypass port 18 is disposed in a position in the inner wall surface of the cylinder 11 which is posterior to the position where the volume of the cylinder chamber 10 enclosed by the vanes 13*a* and 13*b* and the cylinder 11 is maximized or in a portion of the inner wall surface corresponding to the compression stroke.

The check valve 20 allows a free gas flow to be directed from the cylinder chamber 10 defined by the cylinder 11 in the direction of the valve chamber 21. The valve chamber 21 communicates with one end of the connecting passage 17, as aforesaid, in such a manner that the valve chamber 21 disposed at the back of the check valve 20 is acted upon by the low pressure in a cooling mode operation of the refrigeration unit and by the high pressure in a heating mode operation of the unit.

The operation of the embodiment constructed as aforementioned will be described. The volume enclosed by the two vanes 13*a* and 13*b* and the cylinder 11 is maximized when the two vanes 13*a* and 13*b* are positioned in solid line position as shown in FIG. 2. However, as the rotor 12 is rotated counterclockwise and the two vanes 13*a* and 13*b* move toward phantom line positions, the volume of the internal space of the cylinder chamber 10 becomes smaller, so that the refrigerant can be compressed and discharged through the outlet port 15. When the compressed refrigerant is passed to the circuit 6, as shown in FIG. 1, high pressure will prevail in the connecting passage 17 if the four way valve 2 permits the compressed refrigerant to pass through the circuit in the direction indicated by the broken line arrows (heating mode). Therefore, in a heating mode operation of the refrigeration unit, the high pressure acting on the valve chamber 21 at the back of the check valve 20 brings the end portion 20*a* of the check valve 20 into close contact with the valve seat 19. Thus the compressed refrigerant in the cylinder chamber 10 does not open the check valve 20 in a heating mode operation of the refrigeration unit.

However, in case the four way valve 2 is in such a condition as to permit the refrigerant to flow in the direction indicated by the solid line arrows (cooling mode), low pressure prevails in the connecting passage 17, so that the refrigerant in a portion of the interior of the cylinder chamber 10 disposed between the solid and phantom line positions of the two vanes 13*a* and 13*b* passes through the bypass port 18 and pushes open the check valve 20 to flow out of the cylinder chamber 10 into the valve chamber 21 while the vanes 13*a* and 13*b* move from their solid line positions to their phantom line positions. The refrigerant flowing into the valve chamber 21 is discharged therefrom through the connecting passage 17 in a bypass stream to the low pressure side of the circuit 6. The result is that the effective suction gas flow in the compressor 1 can be made greater and the compressed refrigerant can be made higher in quantity in a heating mode operation of the refrigeration unit than in a cooling mode operation of the unit.

In short, it is essential that the bypass port 18 is located in a position in the wall surface of the cylinder chamber 10 which is disposed posterior, with respect to the direction of movement of the vanes, to the position in which one vane 13*b* is disposed when the volume enclosed by the two vanes 13*a* and 13*b* and the cylinder 11 is maximized or in a position which corresponds to the compression stroke of the rotor 12. Since the rotor 12 mounts two vanes 13*a* and 13*b* thereon, the positions in which the suction port 14 and the bypass port 18 are located should meet the conditions which set the aforesaid limitations. If the rotor of the compressor were provided with only one vane, then the positions of the ports referred to hereinabove could be freely designed depending on the ratio of the load applied to the compressor in the cooling mode to the load applied to the compressor in the heating mode.

Figure 4:
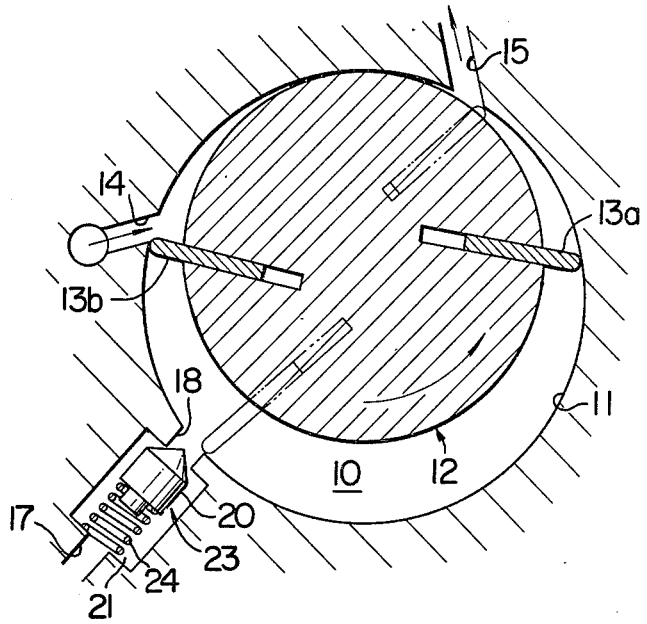
FIGS. 4 and 5 are sectional views showing the essential parts of compressors according to other embodiments of the present invention.

In the embodiment shown in FIG. 2, the check valve 20 is shown as being in the form of plate spring. It is to be understood, however, that the invention is not limited to this specific form of the check valve 20 and that the check valve 20 may consist of a valve body 23 and a coil spring 24, as shown in FIG. 4.

Figure 5:
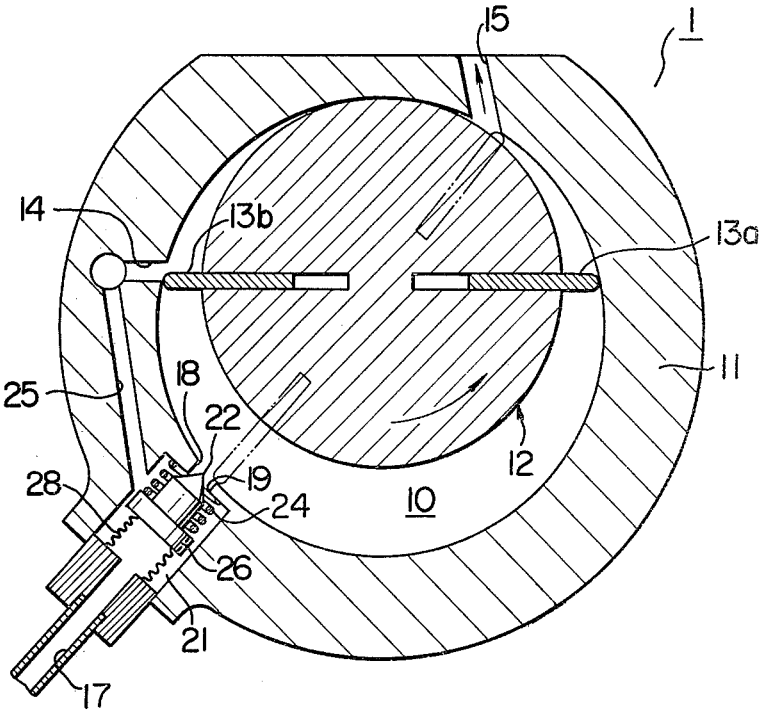
Figure 6:
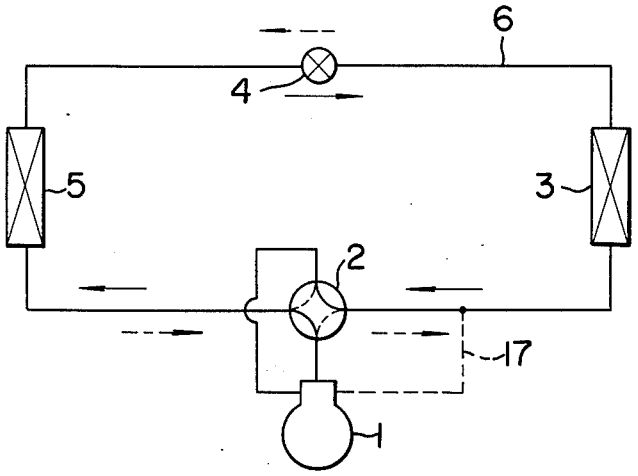
FIG. 6 is a refrigerating circuit diagram in which compressor shown in FIG. 5 is incorporated.

In the refrigeration unit according to the invention, as shown in FIG. 1, the connecting passage 17 is arranged to connect the valve chamber 21 to a point in the refrigerant passage between the four way valve 2 and the inboard heat exchanger 3, and the connecting passage 17 is used concurrently as a bypass without providing any additional path serving specially as a bypass. However, according to the invention, a special bypass 25 in the form of duct within the wall of the cylinder 11 as shown in FIG. 5 may be provided to communicate the valve chamber 21 with the suction port 14. In a second embodiment shown in FIG. 5, the bypass 25 is formed in the wall of the cylinder 11 to connect the valve chamber 21 disposed adjacent the bypass port 18 and communicated therewith to the suction port 14, and a valve body 26 is mounted in the valve chamber 21 and bears against the valve seat 19. A compression spring 27 is mounted between the valve body 26 and the valve seat 19, while a bellows 24 is mounted between an end surface of the valve chamber 21 and the valve body 26. The pressure prevailing in the connecting passage 17 is caused to act on the interior of the bellows 24 as a back pressure which is introduced into the interior of the bellows 24 mounted in the valve chamber 21 through the end of the connecting passage 17 which in turn is communicated at the other end with a refrigerant passage between the four way valve 2 and the inboard heat exchanger 3, which becomes a low pressure area in a cooling mode operation of the refrigeration unit and becomes a high pressure area in a heating mode operation of the refrigeration unit. Thus, like the embodiment shown in FIG. 2, the embodiment shown in FIG. 5 operates such that the refrigerant sucked into the cylinder chamber 10 through the suction port 14 brings the valve body 26 out of engagement with the valve seat 19 and flows directly through the valve chamber 21 and the bypass 25 back to the suction port 14 in a bypass stream in a cooling mode operation of the refrigeration unit. In a heating mode operation of the refrigeration unit, however, the valve body 26 remains in engagement with the valve seat 19, so that no refrigerant flows through the bypass 25 back to the suction port 14.

In the two embodiments shown and described hereinabove, the compressor 1 is constructed such that space in the cylinder chamber 10 is enclosed by the sliding vanes 13*a* and 13*b*. It is to be understood, however, that the present invention can also have application in a stationary vane type compressor in which the rotor 12 rotates about the center axis of the cylinder 11.

Figure 7:
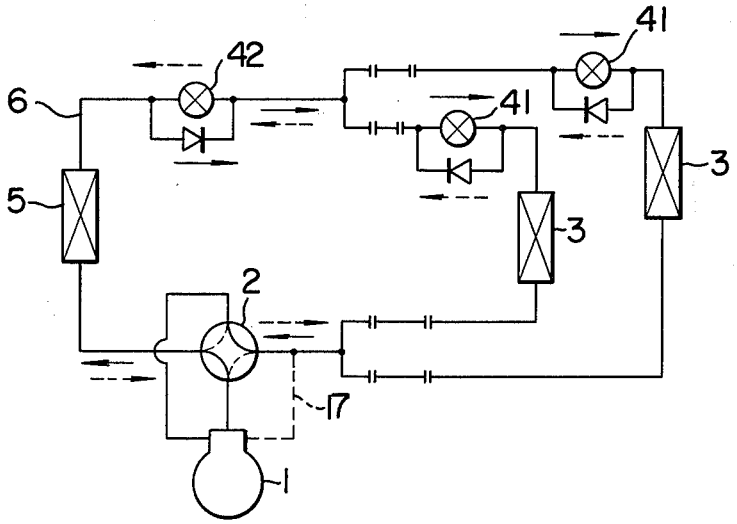
FIG. 7 is another refrigerating circuit diagram according to another embodiment of the present invention.

FIG. 7 shows another refrigerant circuit of the heat-pump type refrigeration in which a plurality of inboard heat exchangers 3, 3 are connected to one outboard heat exchanger 5 through expansion valves 41, 41, 42 each connected in parallel with a check valve. It is to be understood that a compressor according to the present invention therein may be used as a circuit block in such refrigerant circuit.

From the foregoing description, it will be appreciated that the present invention provides a capacity control system of a compressor for a heat-pump refrigeration unit comprising a bypass port formed in the wall of the cylinder chamber 10 of the compressor and opened to a portion of the cylinder chamber corresponding to the compression stroke, a bypass communicating the bypass port 18 with the suction side of the compressor, and a valve 20, 23 or 26 mounted in the bypass port 18 for opening and closing the bypass. The pressure prevailing in a refrigerant passage which becomes a low pressure area in a cooling mode operation of the refrigeration unit and becomes a high pressure area in a heating mode operation thereof acts on the back of the valve, so that the bypass can be automatically opened or closed dependent upon a change in the pressure. Therefore, by switching the refrigeration unit from a heating mode to a cooling mode or vice versa by means of the four way valve 2, it is possible to cause a change to occur in the back pressure applied to the valve 20, 23 or 26 and to automatically open or close the valve, thereby permitting the effective suction gas flow in the compressor to be increased to a higher level in the heating mode than in the cooling mode. Since such control of the effective suction gas flow can be automatically effected dependent upon a change in pressure in the refrigerant circuit, no special operation exclusively for causing a change in the effective suction gas flow is required to bring about such change therein when the refrigeration unit is switched from a cooling mode to a heating mode or vice versa. This simplifies the manipulation of the refrigeration unit and renders the controller less complex.

When the connecting passage 17 is connected at one end thereof to the valve chamber 21 and at the other end thereof to a point in the refrigerant passage between the four way valve 2 and the inboard heat exchanger 3, as shown in FIGS. 2 and 4, the valve 20 may be in the form of a check valve of a simple construction. When this is the case, the connecting passage 17 can be used concurrently as a bypass.

What is claimed is:

1. A capacity control system of a compressor for a heat-pump refrigeration unit comprising:

bypass port means formed in a wall of a cylinder chamber of the compressor and adapted to open into a portion of the cylinder chamber in which portion the compression stroke is effected;

bypass means communicating said bypass port means with the suction side of the compressor; and valve means mounted in said bypass port means for opening and closing said bypass means, said valve means having its back acted upon by the pressure fed from a refrigerant passage, which becomes a low pressure area in a cooling mode operation of the refrigeration unit and becomes a high pressure area in a heating mode operation thereof, in such a manner that the valve means can be automatically opened or closed to open or close said bypass means dependent upon change in the pressure within said refrigerant passage.

2. A capacity control system as claimed in claim 1 wherein said bypass means is formed in the wall of the cylinder chamber to directly communicate said bypass port means with a suction port of the cylinder without causing the connecting passage means to communicate with said bypass means, and said valve means comprises check valve means mounted at one end of the connecting passage means and permitting a refrigerant to flow through said bypass means from said bypass port means to the suction port of the compressor when the check valve means is in an open position.

3. A capacity control system as claimed in claim 1 wherein a rotor eccentrically mounted in a cylinder chamber of the compressor has a pair of sliding vanes mounted thereon in diametrically opposed positions, a suction port is formed in the wall of the cylinder chamber to open in a position where the vane on the suction side gets out of communication with said suction port when the volume enclosed by said two vanes, the wall of the cylinder chamber and the rotor is maximized, and wherein said bypass port means is positioned to be opened in a portion of the cylinder chamber which is posterior to said position of the suction port with respect to the direction of rotation of said rotor.

4. A capacity control system of a compressor for a heat-pump refrigeration unit comprising:

bypass port means formed in a wall of a cylinder chamber of the compressor and adapted to open into a portion of the cylinder chamber in which portion the compression stroke is effected;

valve chamber means formed in the wall of the cylinder chamber adjacent said bypass port means and adapted to communicate therewith;

connecting passage means communicating said valve chamber means with a refrigerant passage which becomes a low pressure area in a cooling mode operation of the refrigeration unit and becomes a high pressure area in a heating mode operation thereof; and check valve means mounted in said valve chamber means adjacent said bypass port means for permitting a flow of refrigerant to flow freely toward said connecting passage means and adapted to automatically open or close said bypass port means dependent upon a change in pressure within said refrigerant passage;

said connecting passage means serving concurrently as bypass means.

* * * * *